United States Patent [19]

Rausch et al.

[11] 4,043,623

[45] Aug. 23, 1977

[54] WEAR RESISTANT FILAMENT WEAR GUIDES AND METHOD OF MAKING THE SAME

[75] Inventors: John J. Rausch, Antioch; Ray J. Van Thyne, Oak Lawn, both of Ill.

[73] Assignee: Surface Technology Corporation, Oak Lawn, Ill.

[21] Appl. No.: 606,755

[22] Filed: Aug. 22, 1975

Related U.S. Application Data

[63] Continuation-in-part of Ser. No. 388,812, Aug. 16, 1973, abandoned.

[51] Int. Cl.[2] ..... F16C 27/00

[52] U.S. Cl. ..... 308/238; 242/157 R; 308/241

[58] Field of Search ..... 428/148; 29/195; 242/157 R, 157 C, 43.2; 308/238, 241

[56] References Cited

U.S. PATENT DOCUMENTS

| | | | |
|---|---|---|---|
| 3,080,134 | 3/1963 | England et al. | 242/157 R |
| 3,080,135 | 3/1963 | Steijn | 242/157 R |
| 3,086,722 | 4/1963 | Altice et al. | 242/157 R X |
| 3,787,229 | 1/1974 | Rudness | 242/157 R X |

*Primary Examiner*—Philip Goodman
*Assistant Examiner*—Gene A. Church
*Attorney, Agent, or Firm*—Albert Siegel

[57] ABSTRACT

Filament wear guides which are characterized by excellent resistance to abrasive filament wear. Also, the method of their fabrication. A chromium surface on a substrate is controllably oxidized or nitrided and oxidized. Such oxidation or nitriding plus oxidizing is accomplished thermally. The coatings consist of oxide alone, or oxide formed in conjunction with the nitride depending upon the treatment employed. Resulting chromium oxide or oxy-nitride surface layer is nonparticulate and substantially impervious.

5 Claims, 1 Drawing Figure

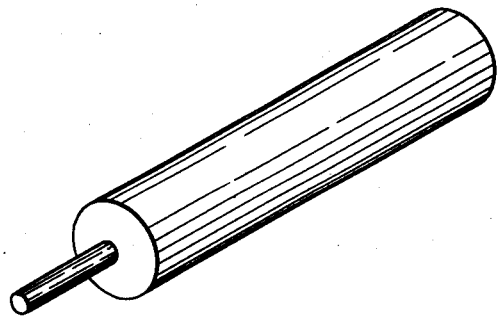

WEAR RESISTANT FILAMENT WEAR GUIDES AND METHOD OF MAKING THE SAME

CROSS REFERENCE TO RELATED APPLICATION

This application is a continuation-in-part of our copending application of the same title Ser. No. 388,812 filed Aug. 16, 1973 now abandoned.

BACKGROUND OF THE INVENTION

The present invention relates to chromium oxide or chromium oxynitride coated filament wear guides and to the method of their manufacture.

As is well-known to workers in the field, in the handling of threads, yarns and the like, the guide structures over which the threads, etc. pass must be characterized by both excellent wear resistance and controlled friction as between the running thread and the guide surface. The problem has been somewhat magnified in recent years by the development and growing use of synthetic threads which are even more abrasive than naturally occurring fibers. For efficient production without undue down time to replace the guide members (along with the replacement cost thereof) it is highly desirable that such guides serve for very extended periods without causing filament damage. To provide a method of readily and easily producing such desirable new guides is one of the principal purposes of this invention. As is set out below in some detail the oxidized or nitrided and oxidized structures produced as herein taught are very well suited for textile wear guide purposes.

We recognize that, generally speaking, the use of a chromic oxide surface on a thread guide device is old in that art. See U.S. Pat. No. 3,080,135 of R. P. Steijn. Such patent discloses the making of textile wear guides having a chromic oxide operating surface by the following methods:

a. from solid chromic oxide pieces—ceramics—followed by grinding to the desired smoothness; and
b. flame spraying of chromic oxide onto a substrate, then followed by grinding, etc., to the desired smoothness.

In practice we find that such prior art devices suffer various shortcomings which are readily overcome by the use of the present invention. The solid ceramics not only are relatively brittle, with the attendant handling and installation problems in commercial use, but also are generally made with a high friction surface which necessitates complex secondary finishing operations to provide controlled friction at the surface. Similarly, the ceramic coated metals, produced by flame spraying do not inherently have usable low friction surfaces as fabricated. Both of these materials are rather rough, have undesirable snagging characteristics, and cause yarn damage unless extensively finished in a secondary operation.

It also should be noted that many textile wear guides are very small structures. As is alluded to in the Steijn patent, the chromic oxide flame spraying technique is mostly limited in application to parts having relatively simple geometry because of the line-of-sight nature of the process.

U.S. Pat. Nos. 3,526,486 and 3,567,599 disclose the oxidizing of very thin chromium plating to improve the corrosion resistance of the structures. Similarly, U.S. Pat. No. 3,480,483 shows the oxidation of very thin chromium coatings applied to the cutting edges of razor blades. U.S. Pat. No. 3,743,551 is directed to razor blades also having exceptionally thin coatings of chromium oxide and nitride thereon. All such coatings which have a maximum thickness of a few hundred Angstrom units, do not have the outstanding abrasive filament wear resistance as produced in the devices of our invention.

Another prior art patent is that of Rudness, U.S. Pat. No. 3,787,229 "Low Friction, Wear Resistant Material". Here spheres or spheroids of various ceramic materials are partially embedded in a matrix or binder layer. Mentioned as binders are various resins, rubber, ceramic, glass and metal which are capable of adhering to the substrate and of retaining the embedded rounded particles thereon. Such patent shows that the resulting surface consists of at least two substances—the hard, discrete particles embedded in a softer matrix binder.

In the present invention, on the other hand, a chromium layer deposited on the filament wear guide shaped substrate is oxidized or oxynitrided by reaction with an oxidizing or oxy-nitriding reactant to form a surface which is in conformity with the layer. If such layer is smooth and uninterrupted the chromium oxide or oxy-nitride replicates on this. If the chromium layer has a so-called "matte" finish, i.e., somewhat wavy, so also with the reaction layer reacted thereon. And if the chromium has a crack mosaic, as is oftentimes the case, the reaction product conforms to this with the added proviso that the reaction layer or zone is quite continuous.

Furthermore, in distinction to such prior art teachings, we have developed a method of forming either chromium oxide or chromium oxynitrided coated thread guides, or the like, which are not brittle, have excellent handling characteristics, are formed directly upon oxidizing or nitriding plus oxidizing without the necessity of a secondary surfacing operation, and are useful in making thread guides of practically any size.

The chromium oxide or oxy-nitride surfaces resulting herefrom also offer numerous advantages which will be set forth as this description proceeds.

In the present invention, a chromium deposit on a substrate member in the form of a textile wear guide is oxidized or nitrided plus oxidized.

Accordingly, a principal object of our invention is to provide devices characterized by excellent filament wear abrasion resistance and controllable friction to filaments passing thereover by the practice of the present process.

Another object of our invention is to provide a novel method of producing filament wear guides having an oxidized or nitrided plus oxidized chromium surface zone thereon.

These and other objects, features and advantages of our invention will become apparent to those skilled in this art from the following detailed disclosure thereof and the accompanying drawing, FIG. 1, which illustrates one representative embodiment of the present devices.

In the present specification reference is made to "thermally formed" oxide or oxy-nitride layers on a chromium surface. By this is meant that such layers are formed by reaction with oxygen or nitrogen and oxygen at elevated temperatures.

DESCRIPTION OF THE PREFERRED EMBODIMENTS

We have found that a thermally formed oxide which is developed as a surface layer on chromium plate has outstanding resistance to abrasive filament wear. In the practice of this invention, for reasons subsequently considered in this specification, the chromium layer or surface must be essentially pure and have a thickness of at least 5 microinches.

For most applications the preferred range of chromium thickness is from 0.1 to 4 mils.

We would also note that the rate of nitriding of chromium is considerably more rapid than the rate of oxidation. At temperatures above 1800° F, there is an abrupt increase in the rate of nitriding.

We find that certain unique metallographic structures are formed when electrodeposited chromium is nitrided or oxidized. Such chromium normally contains cracks or similar flaws, many of which run normal to the chromium plate-substrate interface. These flaws are commonly developed in normal commercial plating and chrome plated commercial thread guides have such plating flaws. Techniques exist to minimize the occurrence of such flaws. However, in any case, upon heating the material stress relief causes the chromium to crack thereby forming a mosaic crack network boundary when viewed normal to the surface thereof. When such material is heated in the presence of oxygen or nitrogen, these elements diffuse rapidly along the fault boundaries and penetrate to the chromium plate-substrate interface long before the bulk chromium, i.e., within the mosaic network, is reacted. Nitrogen in particular diffuses very rapidly from the crack boundaries into the bulk chromium and also diffuses rapidly in the lateral manner along the substrate-chromium interface reaction zone. Thus, in addition to planar diffusion from the surface inward, we find that in such materials unique composite structures are formed in which the nitrogen and oxygen, which diffuse along such fault boundaries, react to form compounds which serve to reinforce the entire coating system. In our invention an uninterrupted, continuous chromium oxide phase is presented to the passing thread.

When nitrogen and oxygen are simultaneously present in the reaction environment both nitride and oxide reaction layers are formed. The oxide forms as an outer surface layer with the nitrides beneath. Along crack boundaries the oxide resides at the crack surfaces while the nitride is diffused into the bulk chromium away from the crack boundary. The relative proportions of nitride and oxide that are formed depends upon the relative partial pressure and activity of nitrogen and oxygen present in the reaction environment. If the oxygen partial pressure is relatively high, such as in air, very little nitriding will occur. The presence of very small amounts of oxygen does not seriously impede the rate of nitride formation. Such materials develop a very thin layer of oxide at the surface and crack boundaries of a structure that may be lightly or fully nitrided. We have found such materials to be quite useful in the practice of our invention since they offer the remarkable abrasion resistance of the oxidized surface and the reinforcement or strengthening that is achieved by the rapidly diffusing nitrogen. Similarly, we have found that the chromium can be initially nitrided and subsequently oxidized to develop a surface layer of oxide or oxynitride having outstanding resistance to abrasive filament wear.

We also find that when the oxygen partial pressure is too high as in air at 1500° F, a rather bulky porous oxide surface layer is formed. Such layer has poorer abrasion resistance than that formed at lower oxygen levels and furthermore the roughened surface that is formed has snagging characteristics which make it undesirable as a contacting element for a moving filament. It has wear resistance in itself but suffers from poor adherence to the substrate. We have observed, however, that when such bulky outer oxide is removed, as by grinding, the underlying material is useful in abrasive filament wear conditions.

If the chromium deposit is oxidized in air at lower temperatures a thin, smooth, dense oxide layer can be developed that will have desirable frictional and non-snagging characteristics. We have produced such layers by heating in air for 1 hour at 1200° F and found that the layer offers some useful abrasion resistance but not as good as that produced at higher temperatures and lower oxygen pressures. When heated in air at 1200° F for 22 hours the oxide surface becomes roughened.

When chromium is nitrided or oxidized at low pressures and relatively high temperatures, above approximately 2000° F, the outer layer that forms is rather porous. This is true even at relatively low oxygen pressures. The surface layers that form are quite hard, unlike the friable bulky chromium oxide layers formed for example in air at 2000° F - 2 hours, and have useful abrasion resistance. The porous layers thus formed also serve as an excellent structure for impregnents or for the bonding of additional outer layers. The surfaces formed at these very high temperatures have different frictional and snagging characteristics unlike the surface layers formed at lower temperatures which tend to replicate the original surface finish of a chromium plate. Accordingly, for these purposes we prefer to oxidize or nitride and oxidize at temperatures below 1800° F.

The structures that we form by nitriding and oxidizing have relatively high hardness. Micro-hardness measurements (DPN-50g load) on nitrided chromium specimens vary from 1790 to 2490. The oxide layers that we form have high hardness — in excess of 2000 DPN — however, it is difficult to measure such hardness accurately since the oxide layers are relatively thin.

We have found that sub-microscopic layers of chromium oxide provide useful abrasive wear resistance. However, in a preferred embodiment of our invention, an oxide layer thickness greater than 5 microinches will result in longer erosive life under certain practical operating conditions.

Moreover, for a low friction surface composed of smoothly rounded continuously surfaced nodules, such as that commonly obtained in what is called a matte chromium finish for example, the contact pressure is higher than for a very smooth surface. Thus to obtain greater abrasive wear resistance and retain the smooth nodular surface finish during service life we prefer that the minimum chromium oxide thickness be 10 microinches or greater depending upon the size of the nodules.

One important aspect of our invention is the ability to control spalling tendencies of either the chromium or the reaction zones. This is related to geometry, thickness of chromium, substrate composition and heat treatment. The general principles that control spalling can be seen from the following experimental work.

Filament wear test bars, (illustrated in FIG. 1) 0.375 in. dia. × 2 in. long were prepared of the following substrate materials

| | |
|---|---|
| Armco iron | Fe 99.75% |
| C1080 steel | Fe-0.80 C |
| 446 Stainless steel | Fe-25% Cr |

These were electroplated to produce chromium coating thicknesses of 0.2 and 2.0 mils and the materials were then subjected to a series of oxidizing and combined nitriding and oxidizing heat treatments.

The heat treatments were carried out using tank gases of various purities as follows:

| GAS | GAS PURITY |
|---|---|
| Ar - $5H_2$ | Ar - 99.6, $H_2$ - 99.8 |
| $N_2$ - $10H_2$ | $N_2$ - 99.7, $H_2$ - 99.8 |
| $N_2$ - h.p.d.* | 99.99, max. $H_2O$ - 3ppm |

*high purity, dry

Oxygen additions were made to the atmospheres by bubbling these carrier gases through water at room temperature or at +32° F. All of the runs in which intentional oxygen additions were made were carried out in a sealed hot wall Inconel muffle.

The spalling behavior of the various heat treated filament wear bars is summarized in Table I. When heat treated at 1300° F, there was no spalling observed on any of the materials. When heat treated at 1500° F and 1800° F for 24–48 hours, spalling of the chromium occurred on all of the C1080 bars with 2 mils of chromium. Spalling does not occur for shorter time treatments at these temperatures. With chromium plated 1080 bars, a (Fe-Cr) carbide interface forms and the point of failure in each case was at this interface. The carbide layer was firmly attached to the substrate. The same material with 0.2 mil chromium did not spall during any of these heat treatments. There was no residual chromium present after the nitriding or oxidizing reactions. At 2000° F, the C1080 bars with 2 mils of chromium showed spalling of portions of the oxide layer but the chromium did not spall. The residual chromium of the oxidized specimen was heavily laced with crack boundary oxide growth. Spalling of the chromium was not as prevalent on the thick plated Armco iron bars. However, oxide spalling did occur on most of the 1500° and 1800° F heat treatments. These materials do not form a carbide at the interface. The chromium is bonded directly to the α-(Fe,Cr) diffusion zone. Oxide spalling was also observed on 446 stainless steel wear bars treated at 1500° F, 48 hrs in $N_2$-$10H_2O$ (+75° F). The oxide layer developed during this heat treatment was rather porous and non-adherent even in areas where spalling did not occur.

Table I

Spalling Behavior of Filament Wear Test Pins

| Heat Treatment | | | Substrate and Chromium thickness (mils) | | | | | |
|---|---|---|---|---|---|---|---|---|
| | | | 446 | | Armco Fe. | | C1080 | |
| ° F | Hrs. | Atmosphere | 2.0 | 0.2 | 2.0 | 0.2 | 2.0 | 0.2 |
| 1300 | 48 | (1) | N | N | N | N | N | N |
| 1500 | 24 | (1) | N | N | N | N | C | N |
| 1800 | 24 | (1) | N | N | C* | N | C* | N |
| 1300 | 48 | (2) | N | N | N | N | N | N |
| 1500 | 48 | (2) | O | O | O | N | C | N |
| 1800 | 24 | (2) | N | N | O | N | C | N |
| 1500 | 24 | (3) | N | N | O | N | C | N |
| 1800 | 24 | (3) | N | N | O | N | C | |
| 2000 | 4 | (4) | N | N | N | N | O | N |

Table I-continued

Spalling Behavior of Filament Wear Test Pins

| Heat Treatment | | | Substrate and Chromium thickness (mils) | | | | | |
|---|---|---|---|---|---|---|---|---|
| | | | 446 | | Armco Fe. | | C1080 | |
| ° F | Hrs. | Atmosphere | 2.0 | 0.2 | 2.0 | 0.2 | 2.0 | 0.2 |

Atmosphere Legend
(1) $N_2$ - $10H_2$
(2) $N_2$ - $10H_2O$(+75° F)
(3) Ar - $5H_2$ - $H_2O$(+75° F)
(4) Ar - $5H_2$ - $H_2O$(+32° F)
N - No Spalling
C - Spalling of Chromium
C* - Very Slight Spalling of Chromium
O - Spalling of Oxide All of the chromium plated ferrous substrates can be oxidized or nitrided plus oxidized at 1300° F, that is, below the transformation temperature, without spalling of the chromium or reaction layers. The ferritic stainless steel, which does not transform can be successfully processed over the widest temperature range. When an Armco iron, or other low carbon substrate is used, a relatively thick solid solution interface is formed between the chromium and substrate and spalling does not normally occur in this region. With a high carbon substrate, such as C1080, spalling frequently occurs at the (Fe, Cr) carbide-chromium interface. These chromium coatings are less sensitive to spalling than are the thicker coatings. Spalling of the nitride layers was not observed in any case. We have found that a fully nitrided reinforced chromium plate structure with a moderately thick oxide surface layer can be developed in a combined atmosphere. Alternatively, the chromium plate can be nitrided initially and the surface subsequently converted to oxide. In either case a thicker oxide layer can be produced with less tendency toward spalling of either the oxide or the chromium if nitriding is incorporated in the treatment. We have also found that annealing at elevated temperatures in an inert atmosphere improves adherance when subsequently oxidized at intermediate temperatures above the transformation temperature of the ferrous substrate.

Thus, nitriding which occurs more rapidly than oxidation results in deeper hardening without spalling of the hardened layers. When chromium is heavily nitrided only a very thin surface layer of oxide or oxynitride is required to obtain the remarkable abrasion resistance that we observe. The presence of some oxide at the surface yields the greatest resistance to abrasive filament wear.

The thermally formed coatings of our invention must result from the reaction of essentially pure chromium with oxygen and nitrogen. Thus, to avoid interdiffusion reactions with the substrate that would dilute the chromium during reaction, a minimum chromium thickness of 5 microinches is required.

In order to determine the abrasive filament wear resistance of the various materials of our invention the various oxidized and nitrided plus oxidized wear test pins, 0.375 in. dia. × 2 in. long, were subjected to testing. The tests were run using a string (Shuford No. 24), which was tied to make a continuous length of 30 inches. The string loop is supported by the wear pin at the top and is driven by a 4 in. dia. pulley at a speed of 1800 in/min. The bottom of the pulley is continuously immersed in slurry made of 8 parts water and 1 part Titanox RA10(pigment grade $TiO_2$ powder) from National Lead Corp., which is kept continuously agitated. The force on the pin is 200 grams.

After various periods of testing the wear pin is removed and the depth of the wear groove is measured. Specimens showing no measureable wear were examined microscopically for evidence of polishing or localized chipping of the coating.

The significance of the results can be better appreciated by reference to the following data that were obtained on standard materials:

| MATERIAL | WEAR RATE (mils/hr) |
|---|---|
| Hard Chromium Plate | 3.0 |
| Annealed C1080 | 0.45 |
| Heat Treated 01 Steel (Rc 57) | 0.2 |
| Chemical vapor deposited TiC | 0.035 |

Hard chromium plate wears at an exceptionally high rate in this test. However, even the exceptionally hard chemically vapor deposited TiC shows a significant linear wear rate. For comparison the results of filament wear tests on various oxidized and nitrided plus oxidized chromium plated materials are summarized in Table 2.

Table 2

Filament Wear Test Data

| Substrate | Chromium Thickness (mils) | Heat Treatment Atm. | Heat Treatment °F | Heat Treatment Hrs. | Time (hrs) | Depth of Wear Scar (mils) | Wear Rate (mils/hr) |
|---|---|---|---|---|---|---|---|
| 446 Stainless Steel | 2.0 | (3) | 1800 | 24 | 16 | 0 | 0 |
| 446 Stainless Steel | 0.2 | (4) | 2000 | 1 | 10 | 0 | 0 |
| C1080 | 0.2 | (4) | 2000 | 1 | 8 | 0 | 0 |
| C1080 | 0.2 | (4) | 2000 | 4 | 4 | 0 | 0 |
| C1080 | 0.2 | (3) | 1500 | 24 | 8 | 0 | 0 |
| C1080 | 2.0 | (2) | 1300 | 48 | 11 | 0 | 0 |
| C1095 | 1.0 | (2) | 1500 | 24 | 29 | 0 | 0 |
| Armco Fe | 2.0 | (2) | 1500 | 48 | 12 | 0 | 0 |
| 446 Stainless Steel | 2.0 | (2) | 1800 | 24 | 16 | 0 | 0 |
| 446 Stainless Steel | 2.0 | (1) | 1300 | 48 | 16 | 0 | 0 |
| C1080 | 0.2 | (1) | 1300 | 48 | 8 | 0 | 0 |
| C1080 | 2.0 | (1) | 1300 | 48 | 30 | 0 | 0 |
| 446 Stainless Steel | 0.2 | (1) | 1800 | 4 | 12 | 0 | 0 |
| C1080 | 0.2 | (1) | 1800 | 4 | 4 | 0 | 0 |

Atmosphere Legend (1) $N_2$ - $10H_2$
(2) $N_2$ - $10H_2$ - $H_2O$ (+75° F)
(3) Ar - $5H_2$ - $H_2O$ (+75° F)
(4) Ar - $5H_2$ - $H_2O$ (+32° F)

No measurable wear was obtained on any of the oxidized or oxidized plus nitrided specimens. The same effect was observed for specimens that were nitrided at the lower temperatures in a relatively impure mixture of $90N_2$ - $10H_2$ containing small amounts of oxygen and water. The surface color of the oxidized and oxidized plus nitrided specimens varied from black to dark green.

Nitriding and oxidizing obviously can be produced by a number of methods. Although oxidizing treatments may include anodizing, salt bath immersion, etc., the use of partial pressure oxidizing atmospheres is simple and offers technical and economic advantages.

From the foregoing we would note certain aspects of our invention which should be taken into consideration in the practice of our process.

The chromium should be deposited onto a metallic substrate and one should avoid total interdiffusion of the chromium and the substrate. Such chromium may be deposited completely over the surface of the piece or at least in the area thereof which is to contact the filament. In some instances we find it desirable to have residual chromium between the substrate and outer coating layers. Various metallic substrates may be employed, especially ferrous and ferrous base materials which are preferred. In the preferred embodiments hereof it is quite desirable to employ a substrate which is closely thermally expansion matched to the chromium in order to minimize spalling off of the chromium layer, oxide or nitride upon thermal treatment.

The thickness of the chromium layer is also important. It must be of adequate thickness in order that, when nitrided or oxidized, it resists filament wear and at the same time it must be thin enough to not readily spall off when oxidized or nitrided plus oxidized. We find that chromium thickness should range between at least 5 microinches and 10 mils or more. Process economics would prefer less than 10 mils. In the preferred embodiment hereof the chromium thickness should range from 0.1 to 4 mils.

In our disclosure above we have referred to chromium electrodeposition. Other means of depositing a smooth or nodular chromium layer may also be employed herein.

It will be understood that various modifications and variations hereof may be effected without departing from the spirit or scope of the novel concepts of our invention.

We claim as our invention:

1. A filament wear guide consisting essentially of:

a. a substrate member in the form of a wear guide;

b. a chromium layer on said substrate member at least in the area thereof to be contacted by a filament passing thereover, said chromium layer ranging in thickness from 5 microinches to 5 mils; and c. a composite structure on the surface of and an integral part of said chromium layer, said composite structure being nonparticulate and continuous and being the reaction product of said chromium and a material selected from the group consisting of nitrogen and oxygen and mixtures thereof.

2. The filament wear guide as defined in claim 1 and wherein said surface consists of a chromium nitride zone upon which is present a chromium oxide zone.

3. The filament wear guide as defined in claim 1 wherein said surface consists of a chromium nitride zone upon which is present a chromium oxide zone and the chromium interlayer and surface combined is from 0.1 to 4 mils thick.

4. The filament wear guide as defined in claim 1 and wherein said surface consists of a chromium nitride zone upon which is present a chromium oxy-nitride zone.

5. The filament wear guide as defined in claim 1 wherein said surface consists of a chromium nitride zone upon which is present a chromium oxy-nitride zone and the chromium interlayer and surface combined is from 0.1 to 4 mils thick.

* * * * *